United States Patent [19]

Davies

[11] 3,962,525

[45] June 8, 1976

[54] HOT TOPPING

[75] Inventor: Dillwyn Morgan Davies, Birmingham, England

[73] Assignee: Foseco Trading Limited, Birmingham, England

[22] Filed: Oct. 8, 1974

[21] Appl. No.: 513,173

[30] Foreign Application Priority Data

Oct. 17, 1973 United Kingdom..... 48420/73

[52] U.S. Cl...... 428/446; 148/26; 164/72; 249/201; 252/62; 427/133; 428/538; 428/539

[51] Int. Cl.[2]..... B22D 7/10

[58] Field of Search ..... 117/5.1, 5.3; 164/72; 427/135, 133; 249/201; 252/62; 428/538, 539; 148/26

[56] References Cited

UNITED STATES PATENTS

| | | | |
|---|---|---|---|
| 2,843,898 | 7/1958 | Carter | 117/5.3 X |
| 3,035,318 | 5/1962 | Campbell | 117/5.1 X |
| 3,120,684 | 2/1964 | Gathmann | 117/5.3 X |
| 3,321,171 | 5/1967 | Gorka et al. | 249/201 |
| 3,642,056 | 2/1972 | Rosenberg | 164/72 X |

FOREIGN PATENTS OR APPLICATIONS

| | | | |
|---|---|---|---|
| 1,212,999 | 11/1970 | United Kingdom | 164/72 |

*Primary Examiner*—Ralph S. Kendall
*Assistant Examiner*—John D. Smith
*Attorney, Agent, or Firm*—Cushman, Darby & Cushman

[57] ABSTRACT

Ingot head surface finish is improved by providing a coating of mould flux on the molten metal-contacting surface of hot top lining slabs.

3 Claims, No Drawings

HOT TOPPING

This invention relates to hot top lining slabs and to an improved method of lining the heads of moulds and casting molten metals therein.

In the casting of molten metal to form ingots, molten metal is teemed into an ingot mould, the mould being filled from the bottom upwards. This may be effected by either direct teeming into the ingot mould whereby the initial stream of molten metal impinges on the base of the mould or by uphill teeming whereby the stream is channeled from a funnel into the ingot mould via a port in its base. When the mould is sufficiently full, teeming of molten metal is stopped and the metal is allowed to solidify in the mould. Thereafter, the solidified ingot is stripped from the mould and moved to further processing. However, during the casting of metal ingots, it is common practice to use a hot top mounted on or at the top of an ingot mould for the purpose of containing "feed" or "head" metal and maintaining it molten while the metal in the ingot mould is solidifying. The metal in the hot top is above and in contact with the metal in the ingot mould so that as the metal in the ingot mould solidifies and so shrinks, the feed metal feeds down into the ingot body and thus prevents the formation of shrinkage cavities in the body of the ingot.

In order to facilitate further processing of the cast ingot and in order to minimise losses due to necessary cropping in subsequent treatment processes, it is important that the surface of the cast ingots should be as clean and flaw-free as possible. In the past, much effort has been directed to solving the problem of securing an adequate quality surface on a solidified ingot. It is generally accepted that surface quality may be much improved by incorporating on to the surface of the molten metal during teeming a quantity of liquid fluxing composition. As the molten metal surface rises in the mould, part of this flux composition becomes trapped between the mould wall and the rising meniscus of molten metal and this gives the metal a clean surface when solidified. We have found that while this method possesses substantial advantages, it is restricted in its application being only usable where ingots are bottom or up-hill poured since otherwise the turbulence of the pouring stream of molten metal causes non-metallic inclusions to be present in the cast ingot.

Furthermore, surface quality is often unsatisfactory in many cases where a hot top lining of refractory or exothermic material has been used in the upper regions of the ingot mould. It has been found that the surface quality on the head metal is often adversely affected by the presence of such a hot top lining.

We have now found that the quality of the surface of the metal of the ingot may be substantially improved if the molten metal-contacting surface of any such hot top lining is coated with a flux. Preferably the flux comprises a major proportion of the commercially available materials known as "fly-ash" and "fly-ash floaters." The former is a by-product from the forced combustion of carbonaceous fuel and the latter is obtained as a product skimmed from the surface of lagoons where boiler-ash residues are allowed to settle.

Experimentally, we have determined that a hot-top lining containing or coated with a flux does not particularly adversely affect the heat insulating properties, and the feed of molten metal to the body of the ingot to compensate for shrinkage on solidification may be maintained without difficulty. However, it is found that the application of even a relatively thin layer of flux to the molten metal-contacting surface gives rise to much improved metal surface quality.

According to the present invention there is thus provided a hot top lining slab having on its inner molten metal-contacting face a coating of a mould flux.

The mould flux should consist wholly or predominantly of a fluxing agent of melting point lower than the molten metal to be cast into the mould, for example, in steel casting, fluxing agents of melting points in the range 950°–1350°C. can be used for the coating.

The coating may be effected in any convenient manner and may contain a conventional binding agent in order to keep the coating coherent and adherent to the lining slab.

The coating may extend over the whole or only a part of the slab and may be e.g. 1 – 4mm thick. On casting, the coating melts to form a flux layer which greatly enhances surface finish and improves the yield of sound metal from the ingot. The use of materials which would tend, with the material of the lining slab, to form a slag during casting should, of course, be avoided.

In addition to the above-mentioned materials the flux may be, or be based on, for example, a mixture of alkaline earth and alkali metal oxides, silicates, carbonates or halides. The preferred material for the mould fluxes is fly ash, which may be used as such. The coating may be applied to the components making up the hot top lining prior to their insertion into the top of the ingot mould, or the layer may be applied afterwards if desired.

The present invention includes both slabs of refractory heat-insulating material or exothermic material as defined above, and their use in metal casting.

The following Example will serve to illustrate the invention:

EXAMPLE

A flux composition comprising the following proportions by weight (dry basis):

fly-ash 80%
alkali metal carbonate 13%
inorganic binding agent 7% was mixed with sufficient water to yield a thick paste and trowelled onto the molten metal-contacting faces at a thickness of 2mm of 4 sets each of 4 slabs and 4 cornerwedges destined for use as a hot-top lining assembly.

The assembly, prior to use in the ingot mould, was dried at 105°C for approximately 2 hours.

The hot-top lining assembly was then placed in an ingot mould head and an ingot cast with the mould. After solidification, the ingot had a classic flat-topped feeder head having sides which possessed a surface which was substantially free from deleterious surface defects. In comparison with four ingots cast using uncoated hot-top linings the coated slabs of the present invention afforded an improvement of from 30 – 50% better surface finish and freedom from defects (based on inclusion counts).

I claim as my invention:

1. A hot top lining slab having on its inner molten metal-contacting face a coating of a mould flux, said coating consisting essentially of at least one material selected from the class consisting of fly ash, fly ash floaters, alkali metal silicates, alkaline earth metal silicates, alkali metal carbonates, alkaline earth metal carbonates, alkali metal halides and alkaline earth metal halides.

2. The lining slab of claim 1 wherein the coating has a melting point of 950° – 1350°C.

3. The lining slab of claim 1 wherein the coating is of thickness 1 – 4mm.

* * * * *